US005777654A

United States Patent [19]

Park

[11] Patent Number: 5,777,654

[45] Date of Patent: Jul. 7, 1998

[54] PRINTING METHOD AND APPARATUS IN WHICH A PRINT SHEET IS PRESSED TO A DRUM BY AN INK FILM

[75] Inventor: Keun-yong Park, Suwon, Rep. of Korea

[73] Assignee: Samsung Electronics Co., Ltd., Kyungki-do, Rep. of Korea

[21] Appl. No.: 724,914

[22] Filed: Oct. 2, 1996

Related U.S. Application Data

[63] Continuation of Ser. No. 314,770, Sep. 29, 1994, abandoned.

[30] Foreign Application Priority Data

Sep. 29, 1993 [KR] Rep. of Korea ..... 93-20546

[51] Int. Cl.[6] ..... B41J 2/325

[52] U.S. Cl. ..... 347/176; 347/215

[58] Field of Search ..... 347/172, 174, 347/176, 215; 400/120.02, 120.04

[56] References Cited

U.S. PATENT DOCUMENTS 4,500,219 2/1985 Lange et al. .

5,532,724 7/1996 Inagaki et al. ..... 347/213

*Primary Examiner*—Huan H. Tran

*Attorney, Agent, or Firm*—Sughrue, Mion, Zinn, Macpeak & Seas, PLLC

[57] ABSTRACT

A printing apparatus and method includes the steps of winding an ink film around a drum with guide rollers, detecting the leading edge of a sheet of paper so that the leading edge coincides with a corresponding ink portion of the ink film, winding most of the circumference of the drum with the ink film so that the ink film and paper sheet come into contact with the drum and transferring an image onto the paper sheet conveyed together with the ink film by actuating a printing head.

6 Claims, 5 Drawing Sheets

PRINTING METHOD AND APPARATUS IN WHICH A PRINT SHEET IS PRESSED TO A DRUM BY AN INK FILM

This is a Continuation application of U.S. application Ser. No. 08/314,770 filed Sep. 29, 1994, now abandoned.

BACKGROUND OF THE INVENTION

1. Field of the Invention

The present invention relates to a printer, and more particularly, to a printing apparatus and method which, during printing, is able to control the top and bottom margins of a sheet of paper and print an image without skewing.

2. Description of the Related Art

There are a variety of printers which print image data on a sheet of paper. One such printer is a thermal transfer printer which uses a thermal transfer head for transferring image data with heat and an ink film located under the thermal transfer head so as to print an image on a sheet of paper placed under the ink film. For full color printing, a color thermal transfer printer is constructed to print three colors of yellow, magenta and cyan of a color-separated image in a superposed manner. The image obtained by such a printer is as sharp as a photograph produced using an ordinary camera, which is developed on a sheet of photographic paper.

The thermal transfer printer can be put into practical use in a variety of fields. For instance, it can be used to output an image from an image input apparatus such as a scanner, to realize a computer graphic image, or to output an image of an electron microscope taken by a video camera.

FIGS. 1A and 1B show actual ranges of printing on a sheet of paper according to a conventional printing apparatus. As shown in FIG. 1A, an image 1 is printed with top and bottom margins 2 on the sheet of paper. In FIG. 1B, the image 1 is printed askew.

Such problems in which there are top and bottom margins on a sheet of paper and an image is printed askew will be explained in connection with a drum-type printer as an example. Various conventional printers such as the drum type, a platen type and a roller type all exhibit such problems.

FIG. 2 illustrates a printing operation of the conventional drum-type printer. Referring to FIG. 2, a clamp 8 is used to clamp a sheet of paper 11 and thereby force it into contact with a drum 13. The leading edge of the paper sheet is thus hard to print on, due to presence of clamp 8. When the paper sheet fed from a paper cassette 10 by a paper feeding cam 9 is guided to a guide roller 6 via a paper feeding roller 12 and the clamp 8 is used to press the paper sheet into contact with the drum, if the clamp holds the paper sheet askew, the image will be printed askew.

Such problems, i.e., the presence of margins on the paper sheet or the skewing of the printed image, makes for a poor appearance and contributes to the waste of ink film and paper. Also, the printed image may require contraction due to the margins or may be truncated to conform to the allotted space on the sheet of paper.

SUMMARY OF THE INVENTION

Therefore, it is an object of the present invention to provide a printing apparatus and method which eliminates the need for margins in a sheet of paper and prevents an image from being printed askew, thereby reducing waste of paper and the contraction or truncating of an image. Also, the invention is able to control the margins of the paper sheet like a photograph.

To accomplish the object of the present invention, there is provided a printing method for a printer which conveys a sheet of paper in contact with a drum by using guide rollers and prints an image on the conveyed paper sheet with an ink film. The method includes the steps of: winding the ink film around the drum through a predetermined angle by using the guide rollers; detecting the leading edge of the paper sheet before the paper sheet is supplied between the drum and the ink film so that the leading edge coincides with a corresponding ink portion of the ink film; winding most of the circumference of the drum with the ink film so that the ink film and paper sheet come into contact with the drum by tension of the ink film and move around the drum and transferring an image onto the paper sheet conveyed together with the ink film by actuating a printing head.

To accomplish the object of the present invention, there is provided a printing apparatus for a printer having: a drum for conveying a sheet of paper; a pair of guiding rollers placed around the drum for pressing the paper sheet onto the drum; printing means for printing an image onto the paper sheet; and an ink film located between the paper sheet and printing means. The apparatus also has guiding means placed on at least one side of the left and right sides of the printing means for guiding the ink film so that the ink film is wound around the drum over a predetermined angle via the pair of guide rollers.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE PREFERRED EMBODIMENT

Hereinafter, a preferred embodiment of the present invention will be described with reference to the attached drawings.

Figure 1A:
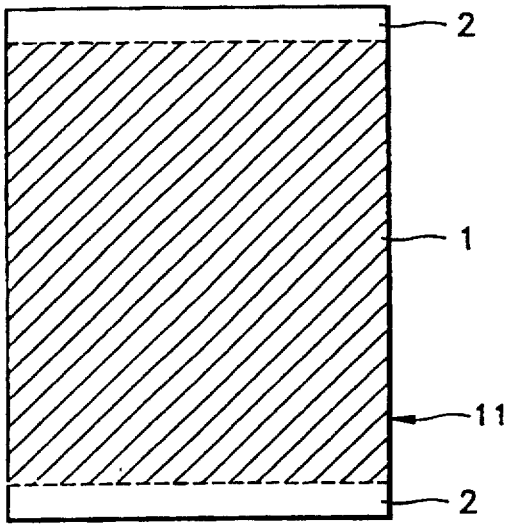
FIG.1A(PRIOR ART)
FIGS. 1A and 1B illustrate a printing range of an image by a conventional printing apparatus.
Figure 1B:
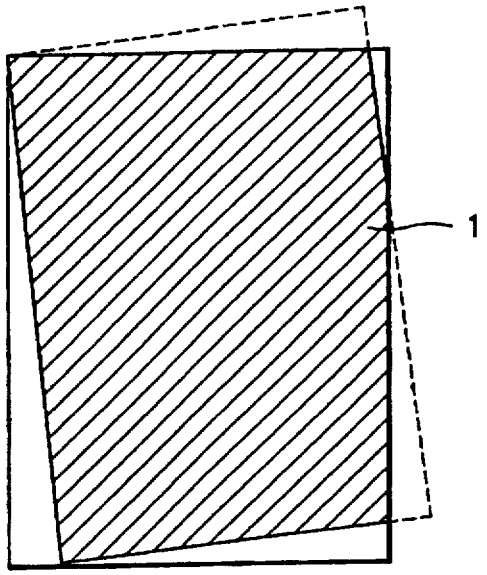
FIG.1B(PRIOR ART)
Figure 2:
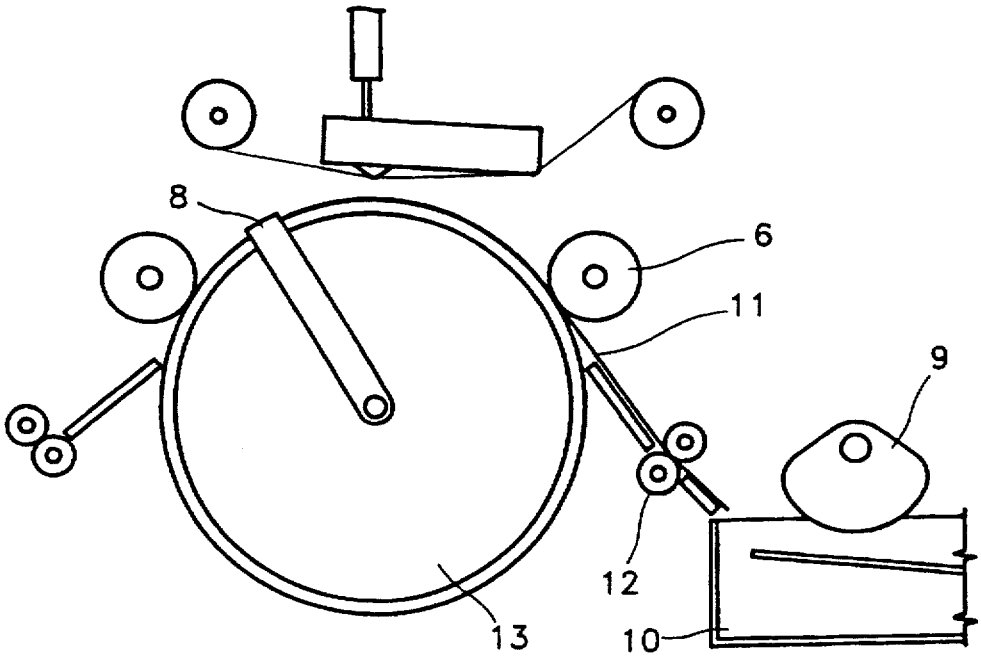
FIG.2(PRIOR ART)
FIG. 2 is a schematic view for illustrating a printing operation according to a conventional drum-type printer.
Figure 3:
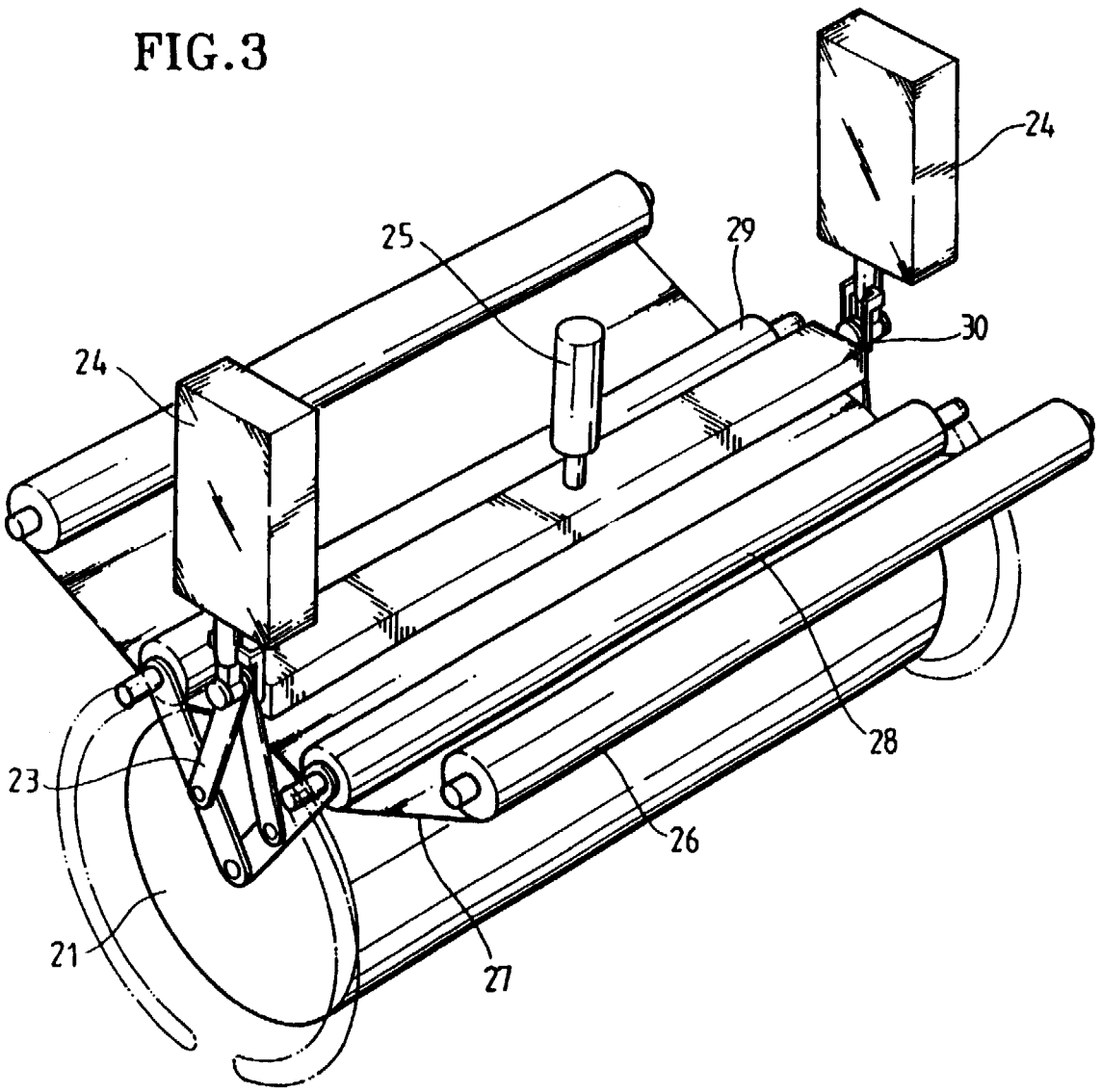
FIG. 3 is a perspective view of a printer according to a preferred embodiment of the present invention.

As illustrated in FIG. 3, a controller 25 is provided above thermal transfer head 30 which transfers image data onto the paper by heat and pressure. The controller 25 raises and lowers the thermal transfer head and presses it onto a drum 21. Drum 21 is placed under an ink film 27 which is rolled around rollers 26 to allow the ink film 27 to travel beneath thermal transfer head 30. As shown in FIG. 3, the film is spooled around both rollers 26 with a portion of the continuous ink film 27 being provided between the rollers 26, the ink film 27 being pressed to the drum 21 by first and second rollers 28, 29 near the top of the drum 21. First and second rollers 28 and 29, which move along the circumference of the drum, are placed on the left and right of the thermal transfer head and above the ink film to force the guided paper sheet and ink film into contact with the drum. A linkage 23 is provided such that the first and second rollers 28 and 29 can be guided around the drum. A pair of solenoids 24 are connected to the linkage 23.

Figure 4:
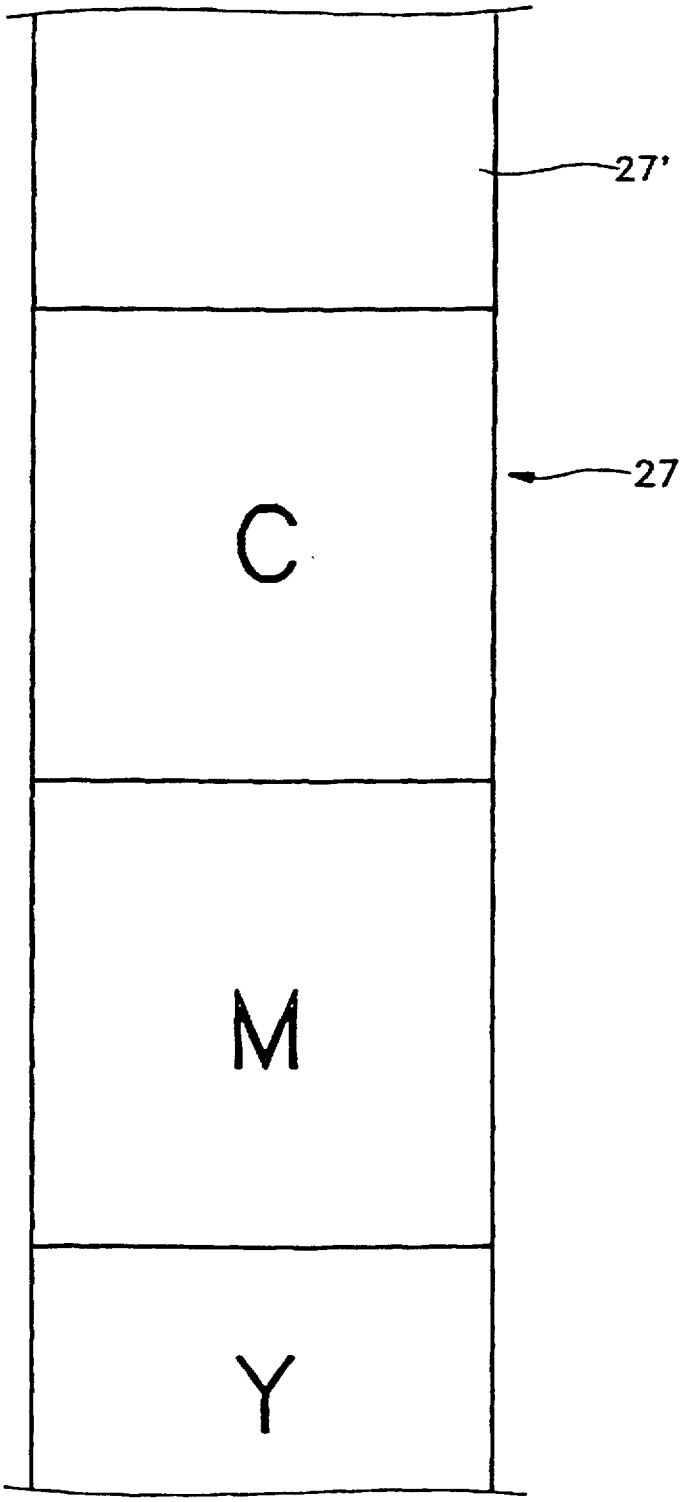
FIG. 4 is a plan view of an ink film for the preferred embodiment of the present invention.

As illustrated in FIG. 4, ink film 27 is formed such that the color portions (C, M and Y) are each slightly longer than a sheet of paper on which an image is to be printed, for sequentially printing the respective colors, cyan, magenta and yellow. The ink film 27 also contains an ink-free portion 27'. The color portions can have a length which is equal to the circumference of the drum.

Figure 5:
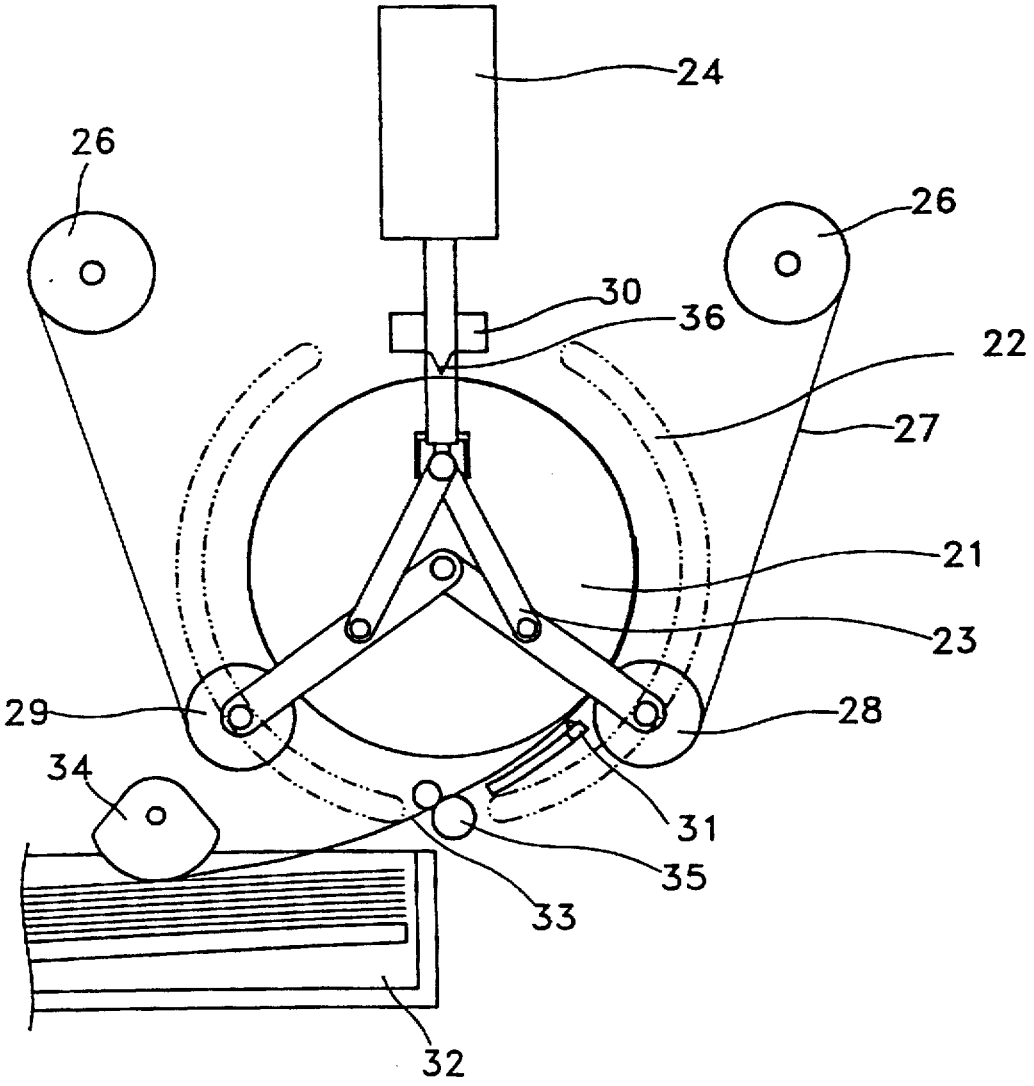
FIG. 5 is a side view of the device of FIG. 3, showing a state in which a sheet of paper is being supplied.

As illustrated in FIG. 5, a sensor 31 is provided for detecting the leading edge of paper sheet 33 and the ink portions of the ink film. A paper feeding cassette 32 having a paper feeding cam 34 is provided for supplying the paper sheets to drum 21. A paper feeding roller 35 is located between paper feeding cassette 32 and first roller 28 to convey the paper sheets to a position between first roller 28 and drum 21.

Now, the operation of the printing apparatus of the preferred embodiment of the present invention will be explained.

Figure 6:
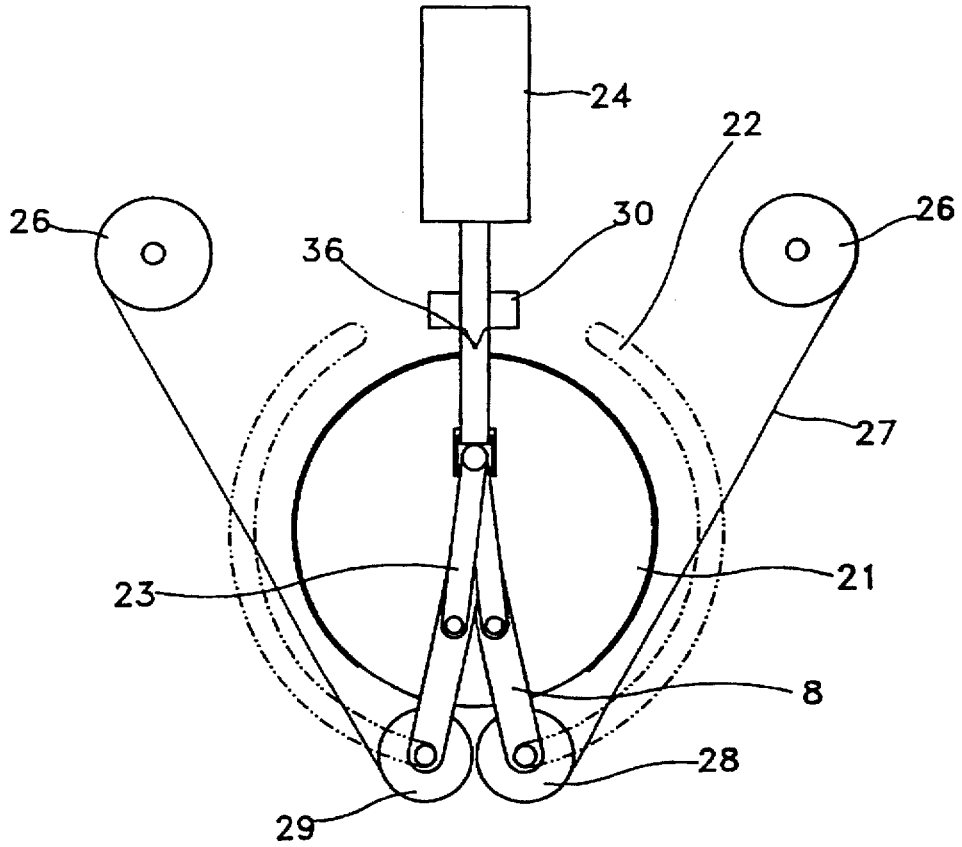
FIG. 6 is a side view illustrating a printing operation.
Figure 7:
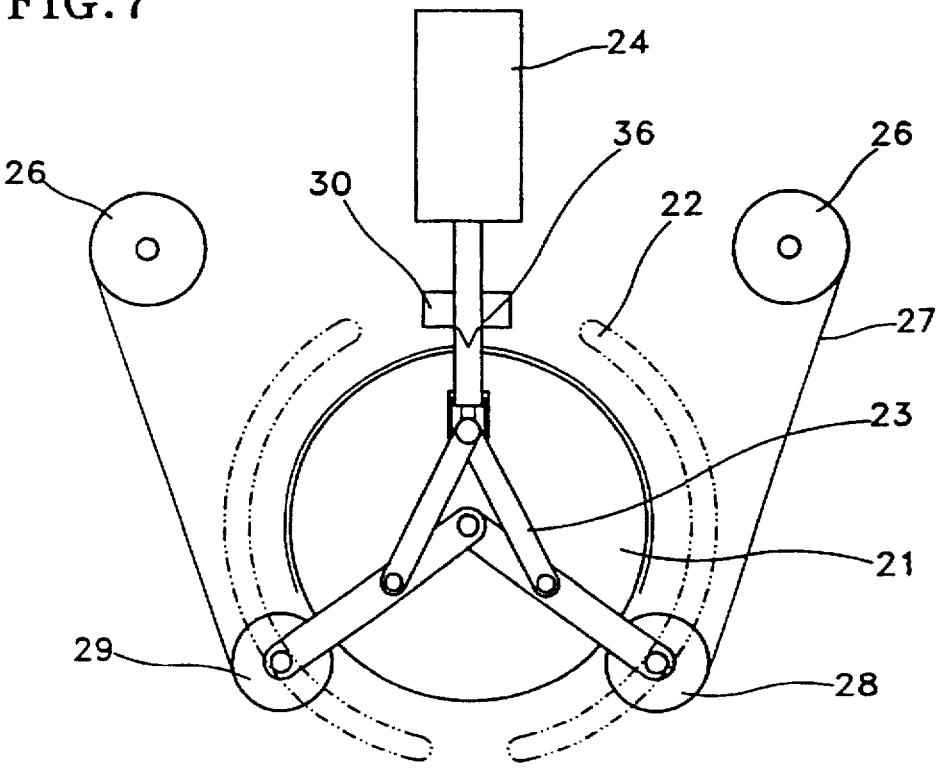
FIG. 7 is a side view illustrating an operation of discharging a sheet of paper.

Referring to FIG. 5, first roller 28 and second roller 29 are lowered by linkage 23 which is pressed downward by dual solenoids 24, to wind ink film 27 around drum 21 through a predetermined angle and to allow the paper sheet to be fed between first roller 28 and drum 21. Subsequently, paper sheet 33 of paper feeding cassette 32 is fed to paper feeding roller 35 by paper feeding cam 34. The paper feeding roller supplies the paper sheet to a position between first roller 28 and drum 21. The leading edge of the paper sheet is sensed by sensor 31 before being inserted between the first roller 28 and drum 21. A signal is generated from sensor 31 and a controller (not shown) stops the operation of paper feeding roller 35 so that the leading edge of the paper sheet is nipped between roller 28 and drum 21 and then rotates drum 21 so that the leading edge of a color portion of ink film 27 to be printed coincides with the leading edge of the paper sheet on the circumference of drum 21 in response to the signal. In the above state, the dual solenoids 24 operate to lower the first roller 28 and the second roller 29 again, so that the ink film 27 pushes the paper sheet against the drum 21. In the above state, the dual solenoids 24 operate to lower the first roller 28 and the second roller 29 by a predetermined distance, so that the first roller 28 presses the ink film 27 and the paper sheet to the drum 21. When the drum 21 rotates with the ink film 27 and the leading end of the paper sheet closely pressed thereto by the first roller 28, the paper sheet, overlapped with the ink film 27, continuously moves on the drum 21. The paper sheet is pressed into contact with the drum by the ink film 27. When the leading edge of the paper sheet moves to an initial printing position 36, a printing head 30 is lowered thereto and heat is applied to the ink film 27, to transfer ink to the paper sheet. Note that when the drum 21 is rotated, it rotates in the counterclockwise direction, with the rollers 28, 29 moving in the clockwise direction, and with the ink film 27 being unspooled by right roller 26 (moving in the clockwise direction) and taken up by left roller 26 (also moving in the clockwise direction). When about half of the intended image is printed onto the paper sheet by printing head 30, first and second rollers 28 and 29, as shown in FIG. 6, are lowered further to the bottom of drum 21 by linkage 23 and solenoid 24 so that ink film 27 is wound around drum 21 through an angle greater than the above-mentioned predetermined angle and the leading edge of the paper sheet coincides with a succeeding portion of ink film 27, and printing continues. When the rollers 28, 29 are moved downwards, the ink film is unspooled from right roller 26, but with left roller 26 moving down the side of the drum 21 to press the slackened film against the drum 21, and when it reaches it lowest point on the bottom of the drum 21, left roller 26 continues to take up the unspooled ink film 27. The sheet 33 then continues around the drum 21 while being held by the tension of the ink film 27, and the leading edge of the sheet 33 travels around to roller 28 where it coincides with the next color portion of ink film 27 being unspooled from right roller 26. Thereafter, printing continues around the drum 21 again as many times as necessary to press all the color portions of the ink film 27 onto the sheet 33. During the printing operation corresponding to the final color portion of the ink film, as shown in FIG. 7, first and second rollers 28 and 29 are raised by linkage 23 and solenoid 24 so that the leading edge of the paper sheet, which is finished printing, can separate from the drum and be discharged from the printing apparatus. When the paper enters a lower area between rollers 28 and 29 it is no longer pressed against the drum by ink film 27.

As described above, the present invention prints an image without margins on a sheet of paper so that there is no need for contracting or truncating the image to be printed. Thus, the waste of paper due to margins can be prevented and the printing of a photograph-like image is realized. Further, the present invention is simplified in structure and reduces the number of movement operations of the printing head, by using tension of an ink film to bring a sheet of paper into contact with the drum.

Control of the invention can be accomplished with a known controller, sensors and actuation devices. For example, a preprogrammed microprocessor based device can be used along with photosensors, motors, and solenoids.

The invention has been described through a preferred embodiment. However, various modifications can be made without departing from the scope of the invention as defined by the appended claims.

What is claimed is:

1. A printing method for a printer which conveys a sheet while the sheet is in contact with a drum by using guide rollers and prints an image on the conveyed sheet with an ink film, said method comprising the steps of:

winding said ink film around said drum through a predetermined angle with said guide rollers;

detecting the leading edge of said sheet before said sheet is supplied between said drum and ink film and rotating said drum to wind said sheet onto said drum, between said drum and said ink film, to a position at which said leading edge coincides with a corresponding ink portion of said ink film;

further winding said ink film around said drum through an angle greater than said predetermined angle so that said ink film covers said sheet and presses said sheet into contact with said drum by tension of said ink film;

rotating said drum; and transferring an image onto said sheet as said sheet is conveyed together with said ink film by actuating a printing head.

2. A printing method for a printer as claimed in claim 1, wherein, said transferring step comprises controlling said printing head so that the printing begins when the leading edge of said sheet moves to an initial printing position.

3. A printing method as claimed in claim 1, wherein said detecting step is accomplished with at least one sensor.

4. A printing apparatus comprising:

a drum for conveying a sheet;

a pair of guiding rollers placed around said drum for pressing said sheet onto said drum;

printing means for printing an image onto said sheet; and an ink film located between said sheet and said printing means;

wherein said apparatus further comprises guiding means for guiding said guiding rollers so that said ink film is contact-wound around said drum through a predetermined angle by said pair of guiding rollers.

5. A printing apparatus for a printer as claimed in claim 4, wherein said guiding means comprises:

a linkage coupled to said guiding rollers for guiding said guiding rollers to a predetermined position along the circumference of said drum;

activation means for moving said linkage; and control means for controlling said activation means.

6. A printing apparatus for a printer as claimed in claim 4, wherein said ink film contains predetermined color portions for producing a full-color image, said color portions being slightly longer than a length of said sheet, and wherein a circumference of said drum is equal to a length of one of said predetermined color portions.

* * * * *